US005497711A

United States Patent [19]

Bobbitt

[11] Patent Number: 5,497,711

[45] Date of Patent: Mar. 12, 1996

[54] GRATE PLATE

[75] Inventor: Billy T. Bobbitt, Sylacauga, Ala.

[73] Assignee: Southern Alloy Corporation, Sylacauga, Ala.

[21] Appl. No.: 426,892

[22] Filed: Apr. 20, 1995

[51] Int. Cl.[6] ..... F27D 15/02

[52] U.S. Cl. ..... 110/278; 110/255; 110/283

[58] Field of Search ..... 110/278, 259, 110/281, 283, 291; 432/77

[56] References Cited

U.S. PATENT DOCUMENTS

| | | | |
|---|---|---|---|
| 2,041,449 | 5/1936 | Adams | 110/278 |
| 4,762,489 | 8/1988 | Schmits et al. | 110/283 |
| 5,086,714 | 2/1992 | Hladun | 110/281 |
| 5,174,747 | 12/1992 | Massaro et al. | 110/281 |
| 5,282,741 | 2/1994 | Massaro et al. | 432/77 |

*Primary Examiner*—Marguerite Macy
*Attorney, Agent, or Firm*—Veal & Marsh

[57] ABSTRACT

Improved grate plates are designed to produce multiple eddy currents in the absence of clinker and to provide even greater air distribution when overlaid by clinker. Each grate plate has a plurality of upwardly flaring wells which open to the upper surface on which the clinker bed is supported. Within each well is at least one semi-annular slot providing ingress for cooling air from a remote source. The slot extends only partially around the wall of the well such that air is injected into the well somewhat tangentially to the flaring surface to induce cyclonic motion of the air which is enhanced by the flared conic walls of the wells. Accordingly, the energy imparted the air by injection is diminished by the rotational energy dissipated and the cooling air's initial vertical component of velocity is diminished. Therefore, the vertical velocity of the cooling air through the bed is largely determined by the interstitial separation of the granular material and the heat absorbed by the air, with the initial vertical velocity playing only a minor role. The plates may be provided with removable plugs which can be used to close the airway through all or part of the wells of a grate to adjust the delivery of the air in gross over the width of the grate. Further, a dam may be provided such that the lowest level of clinker in the bed is stabilized and lateral air migration therethrough is facilitated.

18 Claims, 4 Drawing Sheets

FIG. 5
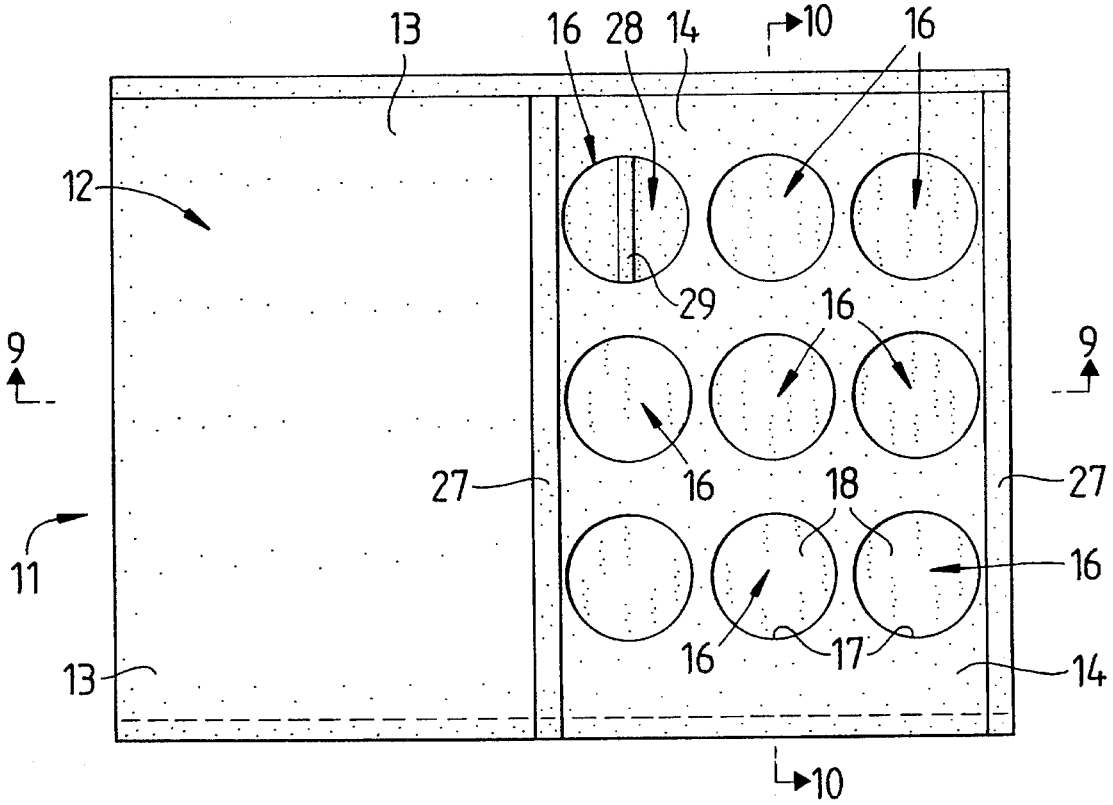
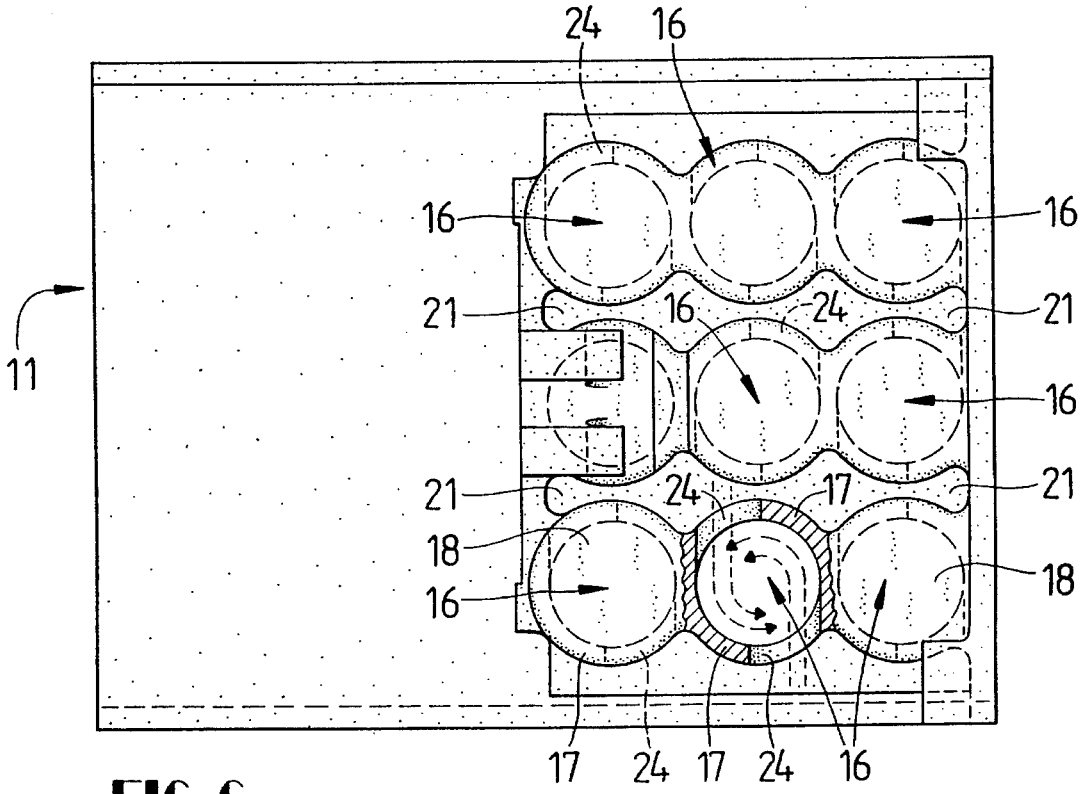
FIG. 6

GRATE PLATE

FIELD OF THE INVENTION

The present invention relates to materials processing in general and more particularly to the handling of hot processed products such as are passed through a kiln or furnace. More specifically, the present invention relates to the construction of grate plates which are used to support a bed of processed material for aeration. In even greater particularity the present invention relates to the construction of a grate plate which facilitates control of the air flow therethrough by directing air passed therethrough in a cyclonic path and by selective closure of vents in the grate plate.

BACKGROUND

Typically grate plates are used in apparatus which handle bulk particulate material, cement clinker or other mineral materials which have passed through a kiln. Examples of similar apparatus and the grate plates of the prior art may by seen in U. S. Pat. Nos. 4,762,489; 4,870,913; and 5,282,741. Grate plates are attached to carrier or support beams by T-bolts or clamps such that they may be easily detached from the beams as needed for replacement by new plates. The grate made up of such plates and beams may be a combination of stationary and moving elements, a traveling grate cooler, a thrust grate cooler and the like. The material, hereinafter referred to by way of example as clinker, is deposited on the grate and distributed thereon as well as possible in a bed or layer. As is well known cooling air from a remote source is supplied to the underside of the grate plates and passes through openings in the plate, thereafter migrating upwardly through the bed to effect cooling of the clinker. Those familiar with the art of cooling a clinker are aware that it may be advantageous, and is in fact sometimes necessary to control the air flow across the width of the grate, providing more or less air flow in certain areas. A significant problem associated with the inability of known grate designs to properly distribute the air is the occurrence of streams of an uncooled clinker over regions of the grate. This problem is potentially exacerbated by the tendency of the cooling air to be discharged upwardly from the grate plate, thereby diminishing the lateral cooling effect on contiguous portions of the clinker bed.

SUMMARY

The object of this invention is to improve the grates as used in the above mentioned cooling apparatus to facilitate a lateral component of air distribution from the grate so that a more even cooling effect is achieved by the cooling air passing through the clinker bed.

Another object of the invention is to provide a simple yet effective means for controlling the quantity of air passed through a particular plate in an array of grate plates.

These and other objects and features of the present invention are accomplished through the advantageous use of the principles of air flow in the design of the grate. It is to be expected that an unrestricted orifice in a grate plate would allow air to pass therethrough essentially vertically such that the cooling air is initially moving vertically. Inasmuch as a positive pressure is maintained and inasmuch as the air immediately begins to undergo temperature elevation as it cools the clinker, the cooling air is urged to rapidly migrate upwardly, and the initial upward velocity yields a cumulative vertical velocity of the air which diminishes the ability of the air to maximize cooling of the clinker. Accordingly, the present invention seeks to impart a lateral velocity component to the air injected to the bed and further to diminish the vertical component of velocity and force in order to increase the retention time of the cooling air in the bed.

This is primarily accomplished in the present invention by facilitating the formation of a cyclonic flow pattern of the cooling air. In effect, the present grate plates are designed to produce multiple eddy currents in the absence of clinker and to provide even greater air distribution when overlaid by clinker. Each grate plate has a plurality of upwardly opening wells which open to the upper surface on which the clinker bed is supported. Within each well is at least one semi-annular slot providing ingress for cooling air from a remote source. The slot extends only partially around the wall of the well such that air is injected into the well somewhat tangentially to the flaring surface to induce cyclonic motion of the air which is enhanced by the slighty flared walls of the wells. Accordingly, the energy imparted the air by injection is diminished by the rotational energy dissipated and the cooling air's initial vertical component of velocity is diminished. Therefore, the vertical velocity of the cooling air through the bed is largely determined by the interstitial separation of the granular material and the heat absorbed by the air, with the initial vertical velocity playing only a minor role. In another aspect of the invention the plates may be provided with removable plugs which can be used to close the airway through all or part of the wells of a grate to adjust the delivery of the air in gross over the width of the grate. Further, a dam may be provided such that the lowest level of clinker in the bed is stabilized and lateral air migration therethrough is facilitated.

BRIEF DESCRIPTION OF THE DRAWINGS

Grate plates embodying features of the present invention are depicted in the accompanying drawings, which form a portion of this disclosure and wherein:

FIG. 5 is a plan view of the grate plate of FIG. 1;

FIG. 6 is a bottom view of the grate plate of FIG. 5;

Description of the Preferred Embodiments

Figure 1:
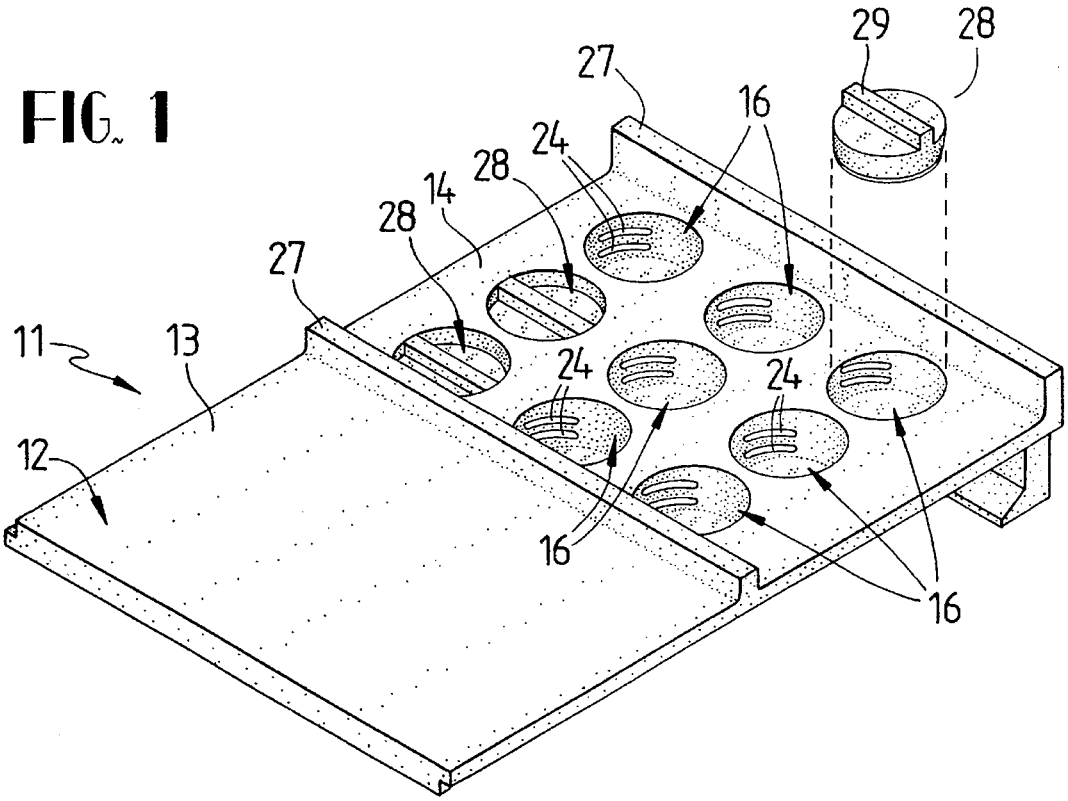
FIG. 1 is a perspective view of a grate plate according to my invention showing the upper surface thereof.
Figure 2:
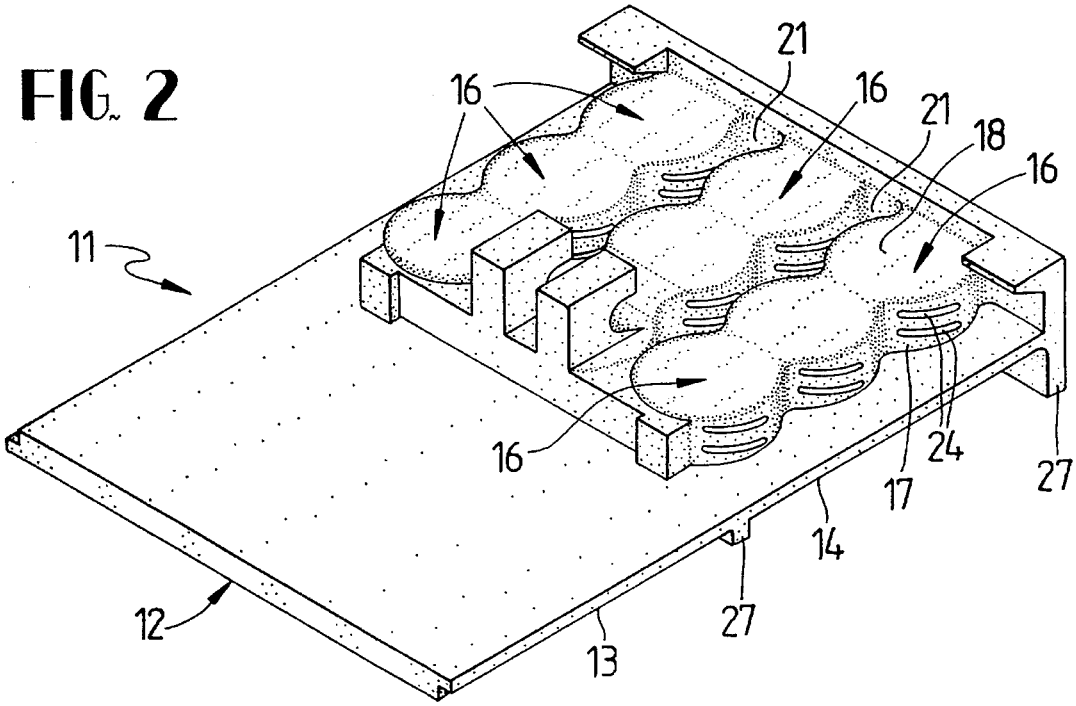
FIG. 2 is a bottom perspective view of the grate plate.
Figure 3:
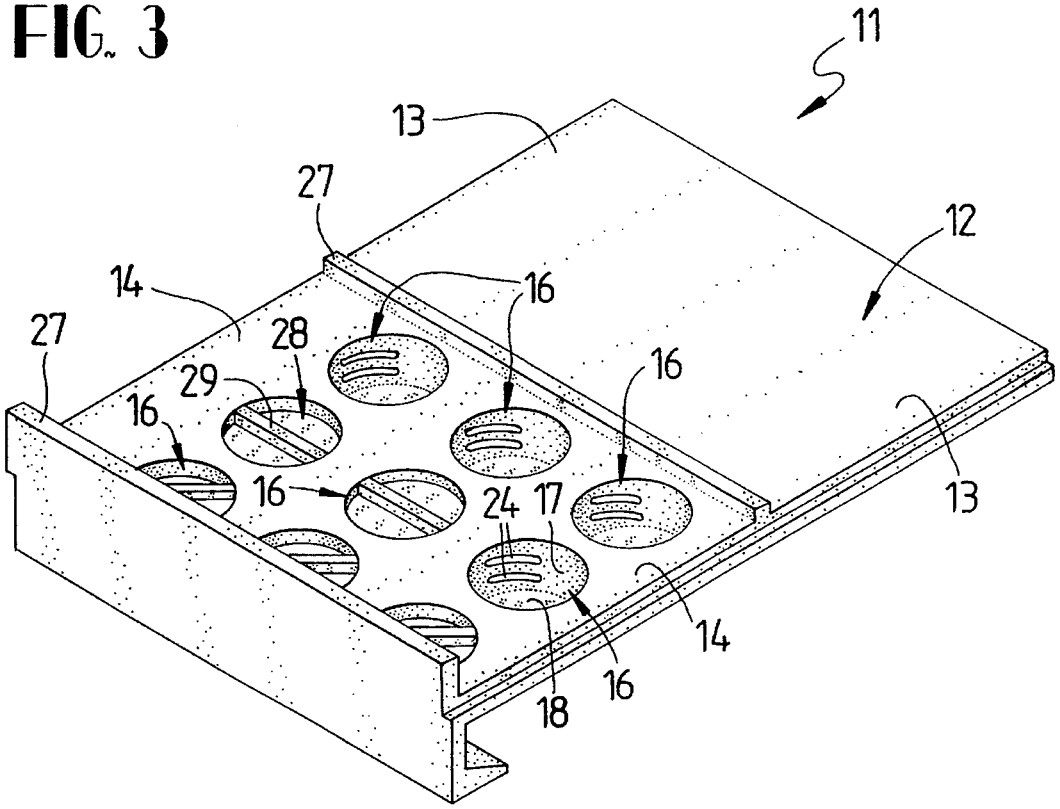
FIG. 3 is a top perspective view of the grate plate from the opposite end as in FIG. 1.
Figure 4:
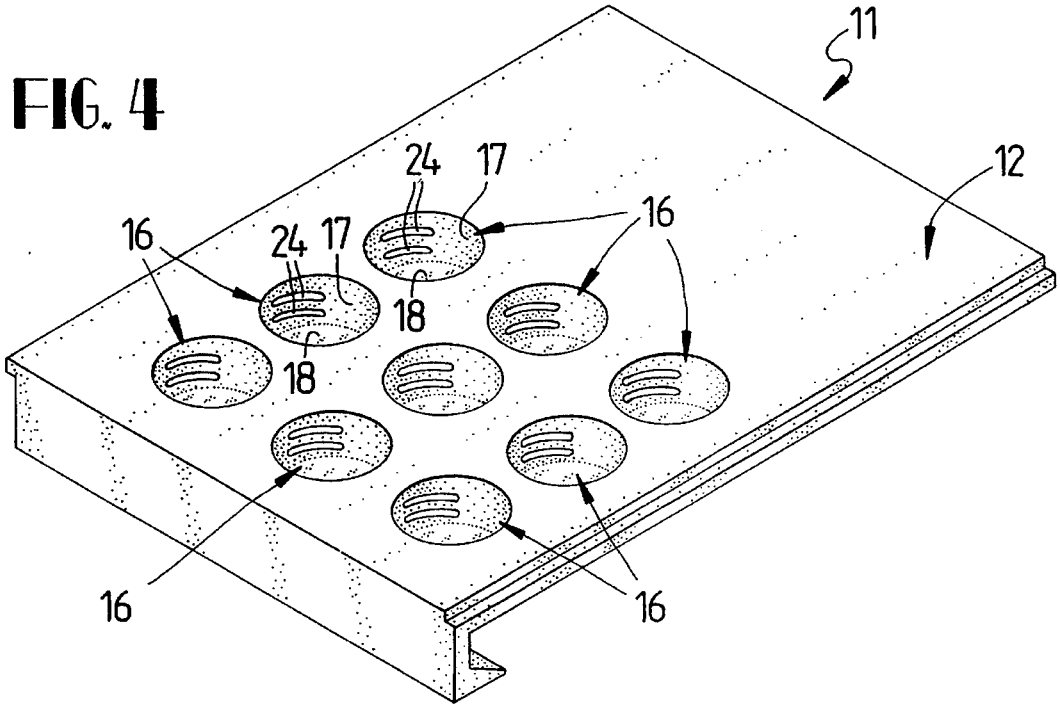
FIG. 4 is a top perspective view of another embodiment of the grate plate.
Figure 7:
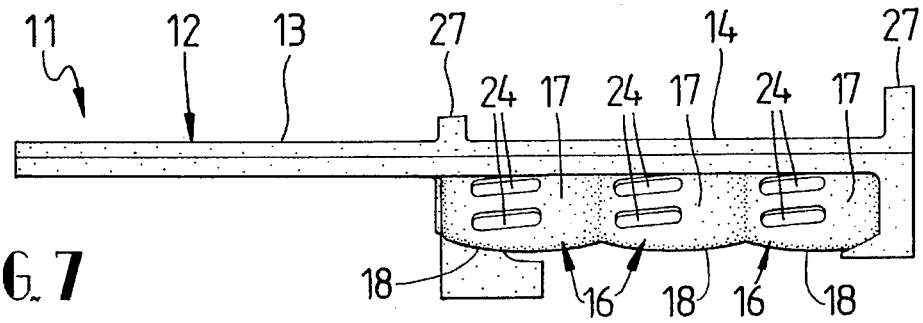
FIG. 7 is a side elevational view of the grate plate of FIG. 6.
Figure 8:
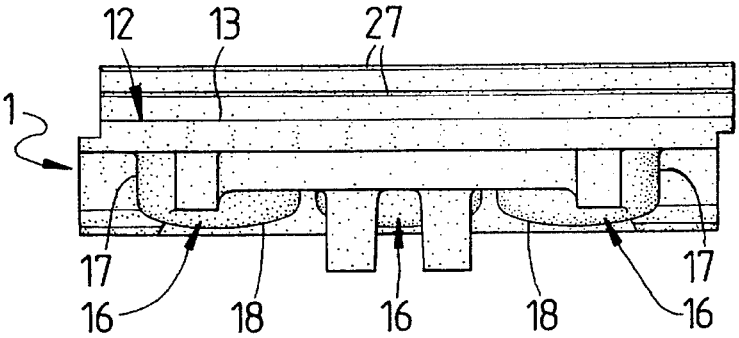
FIG. 8 is an end view of the grate plate of FIG. 6.
Figure 9:
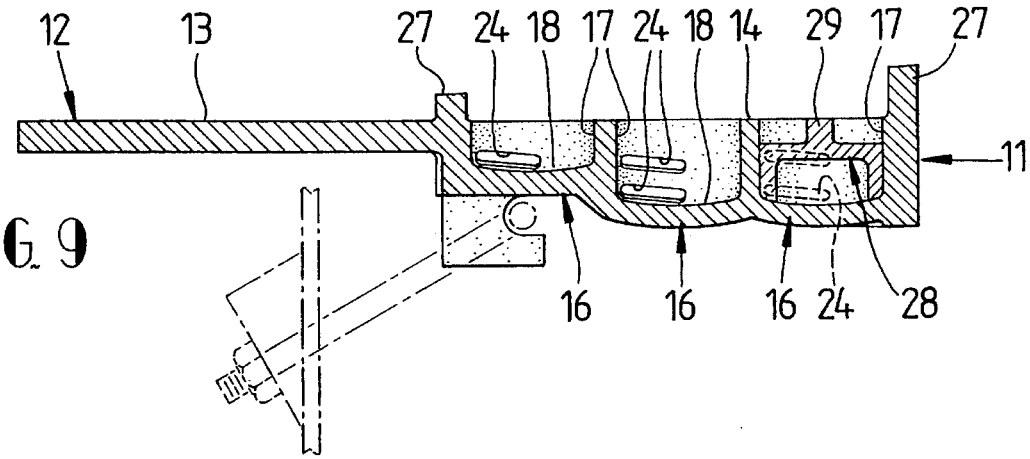
FIG. 9 is a sectional view along lines 9—9 of FIG. 5.
Figure 10:
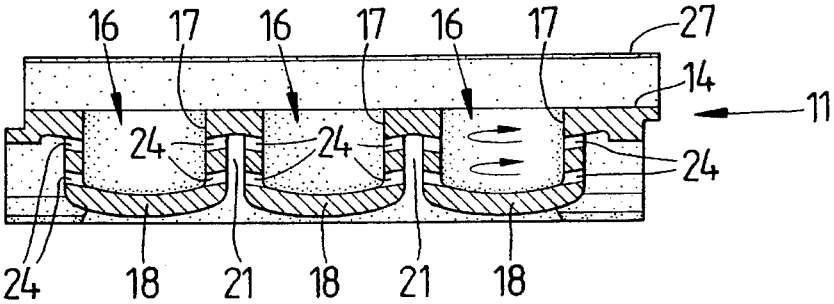
FIG. 10 is a sectional view along line 10—10 of FIG. 5.

Referring to the Drawings for a clearer understanding of the invention it will be appreciated that the grate plates 11 of the present invention may be interchangeable with the grate plates as described in at least some of the U.S. Patents referenced above. Further, the grate plates may be mounted to a subjacent set of support bars (not shown) with the same bolt type attachment, shown in phantom in FIG. 9, as depicted and described in U.S. Pat. No. 4,870,913, at column 3, lines 8–10. With reference to FIGS. 1, 3, and 4, it may be seen that the grate plate 11 of the present invention includes a generally planar upper surface 12, which is composed of two distinct portions. The first portion 13 has a flat surface and is generally the upstream surface relative to material flow over the grate plate. The plates in a grate array may overlap with this portion partially covered. The second portion 14 has a plurality of wells 16 formed therein in rows and columns. As may be seen in sectional views of FIGS. 9 & 10, the wells 16 themselves have side walls 17 and bottoms 18 with the wells tapering slightly from upper surface 12 to the bottom 18. As may be seen in FIGS. 2, 6–8, and 10, the wells 16 may be cast so as to form a longitudinal channel 21 intermediate the columns of wells FIG. 16. The channels 21 provide for air delivery from a conventional source of cooling air as described in the aforesaid prior art patents.

As may be seen in FIG. 5 and the other FIGS., the wells are preferentially round and the walls 17 have formed therein elongated subannular slots 24 which provided communication between channel 21 and the interior of wells 16. Note that the wells 16 are deeper in the downstream rows and that the deeper wells have a second elongated subannular slot formed parallel to the first slot intermediate the first slot and the surface of the plate 11. The slots 24 are inclined relative to the surface of the plate such that air passing from channel 21 to well 16 passes downwardly into the well 16. The sub annular formation of the slot and the round walls of the wells induce a cyclonic flow of air within the well 16, thus utilizing the energy forcing the air into the wells to create a lateral component of force urging the airflow laterally through the bulk material in the bed, and increasing the dwell time of the air in the bed.

As may be seen in all of the FIGS. except FIG. 4, the present invention may also use one or more transverse dams 27, which are proximal the wells 16. The dams 27 extend upwardly from the surface and are designed to trap clinker over the well area of the grate plate, such that the layer of trapped clinker will not move relative to the plate, thereby providing a steady state bed in the wells for the air flow to dissipate through. This layer of clinker also insulates the surface of the plate from wear and heat. As seen in FIG. 4, the grate plate may also be provided without the dams.

Yet another important feature of the invention is the ability to regulate the flow of cooling air to different areas of the cooler grate. This is accomplished using a plurality of flow adjustment plugs 28 which are cast to fit within the wells 16. Each plug in the preferred embodiment is round and slightly tapered to fit snugly in well 16 in a manner which will block the flow of air through the slots. The plugs are of appropriate weight to prevent inadvertent dislodgment and have an upper lug extension 29 which may be grasped to facilitate removal. The height of lug extension 29 should be such that it is lower than the level of the plate surface 12. In an embodiment using circular wells the lug may be used to rotate the plug to loosen the clinker fines which may tend to bind the plug in the well. In rectilinear wells the lug 29 cannot be used for rotation, but may provide sufficient purchase for grasping that the plug may be worked loose. Each operator of a cooler knows where his hot spots are and which areas need additional air flow or less air flow. By using my grate plates and plugs maximum air retention in the clinker and maximum effective air flow delivery can be accomplished to address these needs. As noted hereinabove, clinker has been used as an example of a bulk material in which an air flow is required during its processing, however, the invention should not be considered as limited to clinker or the processing of clinker.

While I have shown my invention in one form, it will be obvious to those skilled in the art that it is not so limited but is susceptible of various changes and modifications without departing from the spirit thereof.

Having set forth the nature of my invention, what I claim is:

1. A grate plate for receiving and transporting material precipitated from a kiln or the like, wherein a plurality of grate plates are supported in cooperative relation to a source of air on an open structure, comprising:

(a) an upper surface for receiving material thereon, said upper surface including a first portion and a second portion;

(b) a plurality of wells formed in said upper surface in said second portion, and extending therebelow, said wells tapering from said surface; and, (c) means for inducing a cyclonic flow of air entering said wells from said source of air.

2. A grate plate as defined in claim 1 wherein said plurality of wells are aligned to form columns and rows of wells in said second portion.

3. A grate plate as defined in claim 2 wherein each of said wells is circular in shape.

4. A grate plate as defined in claim 3 further comprising removable means for preventing air flow through selected one of said wells.

5. A grate plate as defined in claim 1 wherein each of said wells in said plurality of wells is circular in shape.

6. A grate plate as defined in claim 5 further comprising removable means for preventing air flow through selected one of said wells.

7. A grate plate as defined in claim 1 further comprising removable means for preventing air flow through selected ones of said plurality of wells.

8. A grate plate as defined in claim 7 wherein said removable means comprises a tapered plug having a graspable upper extension, said plug being tapered for sealingly seating in a selected well, said extension adapted for removal of said plug by exerting force thereon.

9. A grate plate as defined in claim 8 wherein said plurality of wells are aligned to form columns and rows of wells in said second portion.

10. A grate plate as defined in claim 7 further comprising barrier means for retarding the movement of material over said surface extending upwardly transversely of said plate intermediate said first and second portion.

11. A grate plate as defined in claim 5 wherein said means for inducing cyclonic flow of air comprises at least one elongated passageway formed in each well of said plurality of wells and opening laterally thereof about an arc subtending a minor portion of the wall of said well.

12. A grate plate as defined in claim 11 further comprising a second elongated passageway parallel to said one elongated passageway and positioned in spaced vertical relation thereto.

13. An improvement to a grate plate for use in conjunction with a kiln or the like, wherein precipitated material is supplied with air passing from a remote source through a grate and through a bed of such material supported on said grate, comprising:

a) a plurality of wells formed in said grate plate;

b) means for inducing a cyclonic flow of air from said remote source within each of said wells;

c) and means for selectively preventing the flow of air through any of said wells.

14. The improvement as defined in claim 13 further comprising means for retarding the movement of material over said grate plate comprising a dam formed on said plate proximal said wells.

15. The improvement as defined in claim 13 wherein said wells are aligned to form columns and rows of wells in said grate plate.

16. The improvement as defined in claim 13 wherein said preventing means comprises a tapered plug having a graspable upper extension, said plug being tapered for sealingly seating in a selected well, said extension adapted for removal of said plug by exerting force thereon.

17. An improvement as defined in claim 13 wherein said means for inducing cyclonic flow of air comprises at least one elongated passageway formed in each well of said plurality of wells and opening laterally thereof about an arc subtending a minor portion of the wall of said well.

18. An improvement to a grate plate for use in conjunction with a kiln or the like, wherein precipitated material is supplied with air passing from a remote source through a grate and through a bed of such material supported on said grate, comprising:

a) a plurality of wells formed in said grate plate and adapted to retard the flow of air through said bed; and, b) means for selectively preventing the flow of air through any selected ones of said wells.

* * * * *